US006101691A

United States Patent [19]

Pace et al.

[11] Patent Number: 6,101,691

[45] Date of Patent: Aug. 15, 2000

[54] LARGE FABRIC ROLL LETOFF

[75] Inventors: Edmund L. Pace, Pfafftown; Glenn R. Pierce, Winston-Salem; John R. Everhart, Winston-Salem; James Moore Schenck, Winston-Salem; David L. Kamp, Winston-Salem; Jimmy L. Plyler, Salisbury; John J. Frye, Mocksville; Dennis Starnes, Concord; George S. Noonkester, King, all of N.C.

[73] Assignee: Sara Lee Corporation, Winston Salem, N.C.

[21] Appl. No.: 09/260,174

[22] Filed: Mar. 1, 1999

[51] Int. Cl.[7] ..... D06C 15/14

[52] U.S. Cl. ..... 26/70; 139/1 B; 242/564.5; 242/420.2

[58] Field of Search ..... 26/70; 242/564, 242/564.5, 420.2; 226/172; 139/13

[56] References Cited

U.S. PATENT DOCUMENTS

| | | | |
|---|---|---|---|
| 2,710,153 | 6/1955 | Baumrucker, Jr. et al. | 242/75 |
| 2,731,213 | 1/1956 | Groll | 242/420.2 |
| 3,962,511 | 6/1976 | Foti | 428/246 |
| 4,234,135 | 11/1980 | Conner, Jr. | 242/56 R |
| 4,676,496 | 6/1987 | Honegger | 271/9 |
| 4,858,843 | 8/1989 | Gierse et al. | 242/65 |
| 4,953,400 | 9/1990 | Bossuyt | 139/1 B |

*Primary Examiner*—Andy Falik
*Attorney, Agent, or Firm*—Rhodes & Mason, PLLC

[57] ABSTRACT

A fabric roll letoff for unrolling and inspecting a fabric roll. The apparatus includes: a continuous belt for supporting the fabric roll. A drive system for rotates the belt to letoff the fabric web. The drive system includes a drive roller; a idle roller; and a tension roller. The continuous belt rotates the fabric roll to unroll the fabric web at a constant velocity for subsequent processing. In the preferred embodiment, a pair of unloader arms is connected to the belt drive for receiving the fabric roll and for positioning the fabric roll onto the belt drive. Also, in the preferred embodiment, a guide frame is positioned downstream from the belt drive for directing the fabric web through an inspection area.

39 Claims, 4 Drawing Sheets

LARGE FABRIC ROLL LETOFF

BACKGROUND OF THE INVENTION (1) Field of the Invention

The present invention relates generally to fabric handling systems and, more particularly, to an apparatus for batching and inspecting a continuous, large fabric roll.

(2) Description of the Prior Art

Historically, circular knitting machines have employed take-up rolls for receiving knitted fabric which are capable of holding between about 50 to 250 lb. rolls. Subsequent fabric processing, including bleaching and dyeing require larger continuous quantities of fabric for efficient handling. In order to achieve longer continuous quantities of fabric, fabric from small fabric rolls were stitched together to form a continuous cloth. Problems associated with stitching smaller fabric sections together include varying product quality and properties, like inconsistent courses per inch (CPI), stretch and shrinkage, stretch and distortion of fabric wales, lower productivity due to machine downtime for removing and loading new fabric rolls, and an increased number of seams causing additional waste at cutting.

One solution to this problem is disclosed in co-pending U.S. patent application Ser. No. 08/911,296, filed Aug. 8, 1997, which is hereby incorporated by reference in its entirety. It teaches a circular knitting machine with a tension-controlled large roll take-up assembly which can form very large continuous fabric rolls for improved quality in subsequent processing, including bleaching, finishing, and cutting operations while, at the same time, permits the operator to attend to most machine functions without the need for a ladder or catwalk. However, the fabric roll produced by this machine may be each 450 lbs., or more. As such, more mechanical assistance than the smaller 50-lbs. fabric rolls may be required.

Thus, there is a need for a fabric handling system for letting off a continuous, large fabric roll while, at the same time, permits the operator to automatically batch the fabric roll and inspect the fabric web.

SUMMARY OF THE INVENTION

The present invention is directed to a fabric roll letoff for unrolling and inspecting a fabric roll. The apparatus includes a continuous belt for supporting the fabric roll. A drive system that rotates the belt to letoff the fabric web. The drive system includes a drive roller; an idle roller; and a tension roller. Thus, the continuous belt receives the fabric roll and rotates the fabric roll to unroll the fabric web at a constant velocity for subsequent processing. In the preferred embodiment, a pair of loading arms is connected to the belt drive support structure for receiving the fabric roll and for positioning the fabric roll onto the belt drive. Also, in the preferred embodiment, a guide frame is positioned downstream from the belt drive for directing the fabric web through an inspection area.

Accordingly, one aspect of the present invention is to provide a fabric roll letoff for unrolling and inspecting a fabric roll. The apparatus includes: a belt drive extending between at least one pair of rollers wherein the belt drive rotates about the rollers for unloading the fabric web from the fabric roll; and a guide frame positioned downstream from the belt drive for directing the fabric web through an inspection area.

Another aspect of the present invention is to provide a fabric roll letoff for unwinding a fabric roll. The apparatus includes: a continuous belt for supporting the fabric roll; a drive system for rotating the belt including a drive roller; a idle roller; and a tension roller, wherein the continuous belt receives the fabric roll and rotates the fabric roll to unroll the fabric web at a constant velocity.

Still another aspect of the present invention is to provide a fabric roll letoff for unrolling and inspecting a fabric roll. The apparatus includes: a continuous belt for supporting the fabric roll; a drive system for rotating the belt including a drive roller; a idle roller; and a tension roller, wherein the continuous belt receives the fabric roll and rotates the fabric roll to unroll the fabric web at a constant velocity; a guide frame positioned downstream from the belt drive for directing the fabric web through an inspection area; and a pair of loading arms connected to the belt drive support structure for receiving the fabric roll, the loading arms having a first end positioned away from the belt drive for receiving the fabric roll, and a second end for positioning the fabric roll onto the belt drive.

These and other aspects of the present invention will become apparent to those skilled in the art after a reading of the following description of the preferred embodiment when considered with the drawings.

DESCRIPTION OF THE PREFERRED EMBODIMENTS

Figure 1:
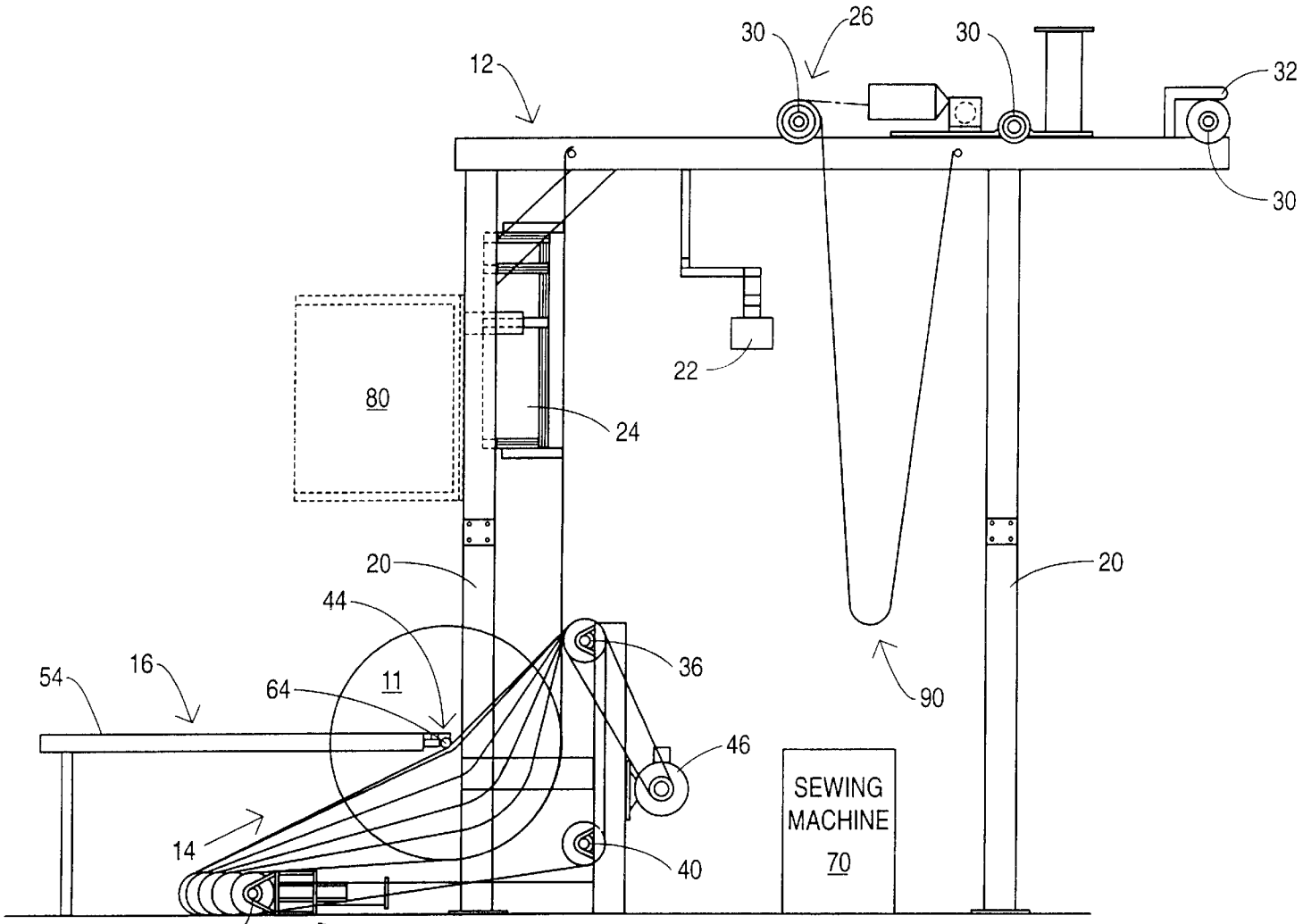
FIG. 1 is a side elevational view illustrating a fabric roll letoff constructed according to the present invention.

In the following description, like reference characters designate like or corresponding parts throughout the several views. Also in the following description, it is to be understood that such terms as "forward," "rearward," "left," "right," "upwardly," downwardly," and the like are words of convenience and are not to be construed as limiting terms.

Referring now to the drawings in general and FIG. 1 in particular, it will be understood that the illustrations are for the purpose of describing the preferred embodiment of the invention and are not intended to limit the invention thereto. As best seen in FIG. 1, a large fabric roll letoff, generally designated 10, is shown constructed according to the present invention. The large fabric roll letoff generally includes a guide frame 12, a belt drive 14, and loader device 16.

The belt drive 14 functions to rotate the fabric roll to unwind the fabric web and includes a drive roller 36, an idle roller 40 and a tension roller 42. The drive roller 36 is connected to a motor 46, which rotates the roller resulting in driving the belt while, at the same time, is capable of stopping the large fabric roll in less than one revolution for safety. In one embodiment, the motor is a 10 horse power unit model number AF4S10T61Q1, manufactured by the Lincoln Company. The motor 46 and drive roller 36 are capable of rotating the belt to provide unrolling of the fabric roll 11 at a surface speed from between about 0 yards per minute (ypm) and up to about 350 ypm. The idle roller 40 provides spacing for the belt as it rotates to unload the fabric roll to prevent the two sides of the belt from rubbing against one another.

The tension roller 42 maintains a constant, predetermined tension on the belt 34. The tension roller 42 includes an arm 50 that extends and contracts depending on the changes of the diameter of the fabric roll due to unwinding. By way of an example, the arm 50 will be extended a lesser distance when the diameter of the fabric roll 11 is large, and a greater distance when the diameter is smaller to maintain the constant tension. In one embodiment, the arm 50 is pneumatically actuated to extend out maintaining substantially constant tension on the belt and, thereby, between the belt and the changing diameter of the fabric roll.

The drive roller 36, idle roller 40, and tension roller 42 are preferably cylindrical-shaped for contacting the belt 34. Rollers 36, 40, and 42 further include a groove cut into the cylinders for housing a notch extending from the belt. The groove functions to maintain the belt on the cylinders and prevent the belt from slipping off the edge. This is particularly important when the fabric roll is off-center and pushes the belt to one side during the batching process. Additionally, the drive roller 36, idle roller 40 and tension roller 42 have a width approximately equal to or somewhat wider than the belt width.

Figure 3:
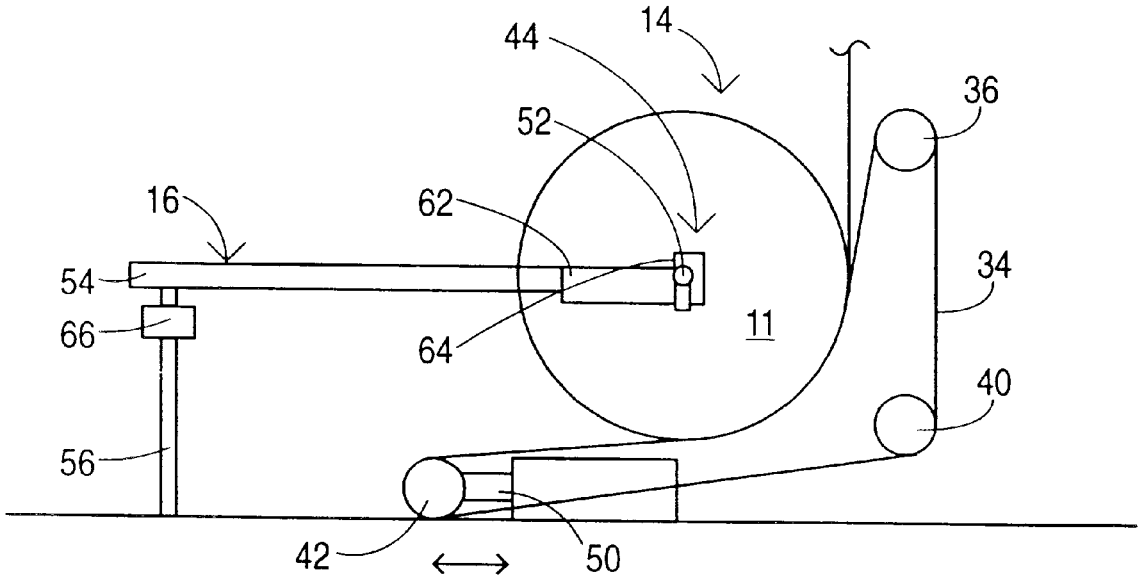
FIG. 3 is an enlarged side view illustrating the arrangement of the belt drive of the fabric roll letoff.
Figure 4:
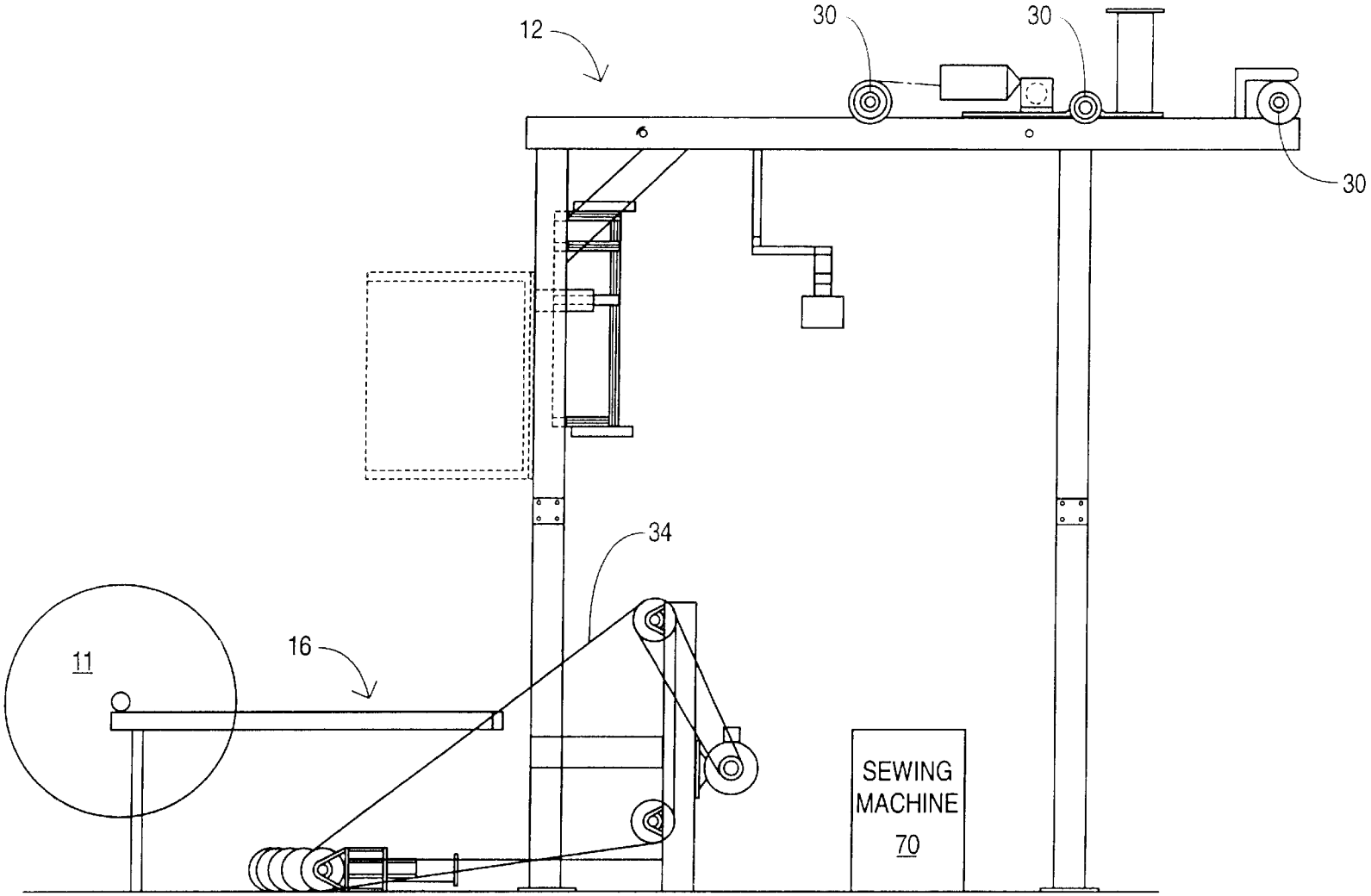
FIG. 4 is a side elevational view illustrating a fabric roll located on the outer edges of the unloader arms prior to being loaded onto the belt drive.

The belt 34 extends about the rollers of the belt drive, as illustrated in FIGS. 1, 3 and 4. In one embodiment, the belt is of a seamless construction for strength and for protecting the surface of the fabric web and may be constructed of PVC plastic. Preferably, the belt 34 has a width larger than the width of the fabric roll 11 to better support the roll. In the preferred embodiment, a notch extends from the inside of the belt to mate with the grooves of the rollers to maintain the belt on the rollers.

Figure 2:
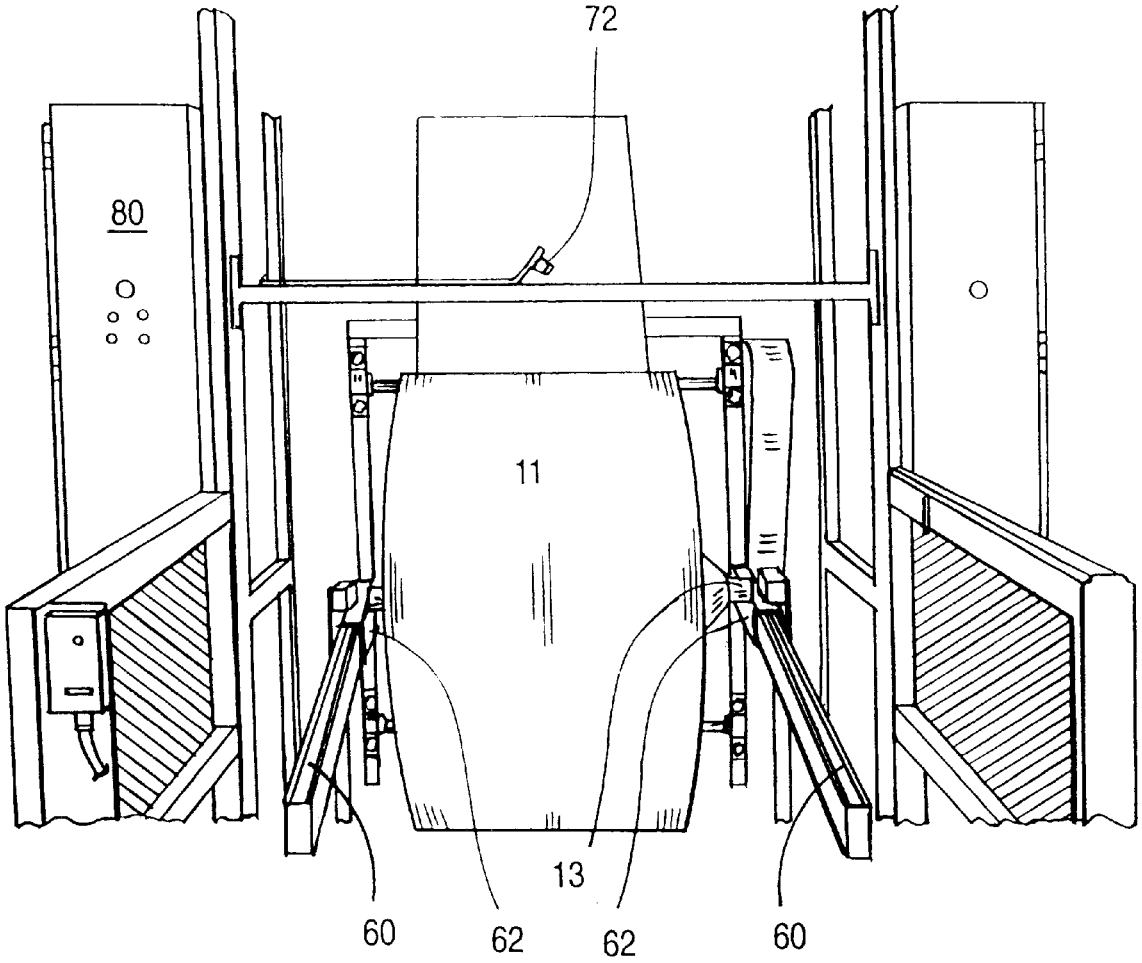
FIG. 2 is a front perspective view illustrating a fabric roll mounted on the fabric roll letoff.

The loader device 16 provides for loading the fabric roll 11 onto the belt drive 14. The loader device 16 include a pair of arms 54 positioned a fixed distance apart, preferably slightly wider than the width of the fabric roll, as illustrated in FIG. 2. Each arm 54 includes a ridge 60 located on the upper side to help facilitate loading of the fabric roll 11 and guide the fabric roll from the first position as illustrated in FIG. 4 to the second loaded position as illustrated in FIG. 1. A central shaft 13 extends through the fabric roll 11 and extends beyond the ends of the fabric roll to fit within the ridges 60 to prevent the fabric roll from dismounting.

An actuator 56 is positioned at a first end of the arms 54 for raising and lowering the first end. Preferably, the actuator is pneumatically controlled, although one skilled in the art will recognize other styles will function properly. A load cell 66 is connected to the loading arms first end for weighing the fabric roll once placed on the loader arms 54. This positioning of the load cell 66 reduces the need for a separate step of weighing the rolls at a separate location also the additional material handling of the fabric roll prior to batching.

Unwinding cradle 44 is positioned at the end of the loader arms 54 to maintain the roll on the belt during the batching process. The unwinding cradle 44 supports the weight of the roll during the batching process. Clamps 64 are mounted on the unwinding cradle 44 for maintaining the fabric roll on the belt drive in a second position as illustrated in FIG. 3. Clamps 64 are selectively positionable between an open orientation for loading and unloading the fabric roll into the unwinding cradle 44, and a locked position for maintaining the fabric roll in a fixed position while rotating on the belt drive. Preferably, the clamps are pneumatically controlled and open when the loader arms 16 are in a lowered position and close when a roll is placed onto the unwinding cradle.

Fabric protector shields 62 are placed over the loader arms 54 once the fabric roll 11 is locked into the second position, as illustrated in FIG. 3. The fabric protector shields 62 have a generally inverted U-shaped cross section to fit over the loader arms to protect the fabric roll from being damaged during the unwinding process. The fabric protector shields 62 are removable for loading and unloading the fabric roll.

The guide frame 12 provides a path for guiding the fabric web after it is unrolled from the fabric roll 11. In one embodiment, the guide frame 12 provides for the fabric web to be guided overhead and away from the belt drive area. Braces 20 may be used for supporting the guide frame structure.

An inspection station is located downstream of the belt drive and includes a camera 22 and backlight 24, as illustrated in FIG. 1. The fabric web passes between the camera 22 and backlight 24 to provide for an inspection for defects and other inconsistencies in the fabric web. Camera 22 is equipped for sensing defects measuring as small as about a one-quarter inch hole or needle cut at a rate of about 320 ypm. The backlight 24 may include a high-frequency light source for illuminating the fabric web to enhance the accuracy and performance of the camera 22. Further details of this arrangement are disclosed in co-pending U.S. patent application Ser. No. 09/259,461, filed Mar. 1, 1999, which is hereby incorporated by reference in its entirety.

A tension drive 26 is positioned downstream of the belt drive 14 for maintaining tension on the fabric web after it is unrolled from the fabric roll. The tension drive includes rollers 30 for further pulling the fabric web away from the belt drive and downstream to further processing. Rollers 30 are preferably of a width greater than the fabric web width and include friction material to pull the fabric web as it passes over the rollers. The rollers 30 are driven in a first direction for moving fabric web away from the belt drive and a second direction which is opposite and moves fabric web towards the belt drive. Anti-backlash arms 32 may be positioned adjacent to the rollers to prevent the fabric web from becoming tangled on the rollers during direction changes.

In use, a fabric roll 11 is placed at the first end of the loader device 16 in a first position, as illustrated in FIG. 4. At this position, the fabric roll shaft 13 is positioned on the ridges 60 of the loader arms 54 with the fabric roll extending between the arms. The fabric roll 11 can be weighed by load cell 66. In one embodiment, the large fabric roll letoff device is capable of handling fabric roll in excess of about 450 lbs. The actuator 56 may then raise the first end of the arms 54 to help move the fabric roll from the first position to the second position on the unwinding cradle 44 positioning the roll over the belt drive 14. Once positioned on the belt drive, the fabric roll is locked in place by the clamps 64 and fabric protector shields 62 are placed over the loader arms to center the fabric roll on the belt drive and also protect the edges of the fabric roll from becoming damaged by rubbing against the loader arms during the batching process.

The fabric web is fed through the guide frame and tension drives 26 downstream of the belt drive 14. The belt drive is then initiated resulting in the belt rotating along the drive roller 36, idle roller 40 and tension roller 42. The fabric roll 11, which is placed on the belt drive 14, rotates thereby unwinding the fabric web off the roll. As the diameter or the roll 11 decreases, the tension roller 42 extends outward via the arm 50 to maintain the constant tension on the belt as illustrated in FIG. 1. The belt rotates at a constant velocity resulting in the surface speed of the fabric roll to vary depending upon the diameter of the roll. Once the fabric web is completely removed from the roll, a sensor 72 positioned in proximity to the belt drive 15, as illustrated in FIG. 2, will shutoff the belt drive and tension drive. The operator may then unload the empty fabric roll shaft 13 from the belt drive and repeat the process.

The fabric web removed from the fabric roll 11 passes through an inspection station and further through tension rollers 30 located downstream of the belt drive. The fabric web passes between illuminated backlight 24 and camera 22 to inspect for defects within the fabric web. Upon finding a defect, the position of the defect will be registered in the control system 80 and the fabric web will move a fixed distance downstream of the inspection station at which point the tension rollers 30 will play the section of the fabric web for removal or marking by the operator. By way of example, FIG. 1 illustrates a section of fabric web 90 being played down from the overhead guide frame 12 to the operator area where the defect can be removed from the fabric web and then re-sewn by sewing machine 70. The fabric web will then be pulled back by the tension rollers 30 and the process reinitiated.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric roll letoff for unrolling and inspecting a fabric roll, said apparatus comprising:

(a) a belt drive extending between at least one pair of rollers wherein said belt drive rotates about said rollers for unloading the fabric web from the fabric roll;

(b) a guide frame positioned downstream from said belt drive for directing the fabric web through an inspection area; and (c) a pair of unloader arms connected to said belt drive for receiving the fabric roll, said unloader arms having a first end positioned away from said belt drive for receiving the fabric roll, and a second end for positioning the fabric roll onto said belt drive.

2. The apparatus of claim 1, wherein said unloader arms are positioned at a predetermined width for supporting outer edges of a central shaft which extends through said fabric roll.

3. The apparatus of claim 1, further including grooves located on the top edge of each unloader arm for positioned the fabric roll on and preventing said fabric roll from falling from said unloader arms.

4. The apparatus of claim 3, further including a fabric protector shield positioned over each of said unloader arms for centering the fabric roll on said drive belt and preventing the fabric roll from becoming damaged during unloading.

5. The apparatus of claim 3, further including clamps positioned on each of said unloader arms, said clamps being selectively positionable between an open position for loading and unloading fabric roll and a closed position for locking the fabric roll on said belt drive.

6. The apparatus of claim 1, further including a scale connected to the unloader arms for weighing the fabric roll.

7. The apparatus of claim 1, further including an actuator for raising and lower said unloader arms, said actuator being selectively positionable in a lowered position for loading the fabric roll onto said unloader arms and a raised position for moving the fabric roll onto said belt drive.

8. The apparatus of claim 7, wherein said actuator is pneumatically controlled to lift fabric roll weighing as much as about 450 pounds.

9. The apparatus of claim 1, wherein said guide frame is elevated above said belt drive.

10. The apparatus of claim 1, wherein said guide frame includes an inspection station for inspecting the fabric web being unrolled from the fabric roll, said inspection station being positioned downstream of said belt drive.

11. The apparatus of claim 10, wherein said inspection station includes a screen having a light source and a camera, the fabric web being unwound from the fabric roll passing between said camera and said screen to allow said camera to inspect the fabric web.

12. The apparatus of claim 10, further including a tension drive for pulling the fabric web after being unrolled from the fabric roll, said tension drive including a plurality of rollers for moving the fabric web.

13. The apparatus of claim 12, wherein said plurality of rollers are selectively operable to move the fabric web downstream away from the belt drive after inspection and upstream towards said belt drive for repair.

14. The apparatus of claim 13, further including anti-backlash arms positioned adjacent to each of said plurality of rollers to prevent the fabric web from becoming jammed in said rollers.

15. A fabric roll letoff for unwinding a fabric roll, said apparatus comprising:

(a) a continuous belt for supporting the fabric roll;

(b) a drive system for rotating said belt including (i) a drive roller; (ii) a idle roller; and (iii) a tension roller, wherein said continuous belt receives the fabric roll and rotates the fabric roll to unroll the fabric web at a constant velocity; and (c) support arms for maintaining the fabric roll on said belt, said support arms being spaced a fixed distance apart for holding a central shaft that extends through the fabric roll.

16. The apparatus of claim 15, wherein said belt is seamless to protect the surface of the fabric web.

17. The apparatus of claim 16, wherein said belt is formed from PVC.

18. The apparatus of claim 15, wherein said drive roller is connected to a motor for rotating said belt at a surface speed between about 0 yards per minute (ypm) and up to about 350 ypm.

19. The apparatus of claim 15, wherein said tension roller is attached to a pneumatic actuator for maintaining substantially constant tension between said belt and the surface of the fabric roll.

20. A fabric roll letoff for unrolling and inspecting a fabric roll, said apparatus comprising:

(a) a continuous belt for supporting the fabric roll;

(b) a drive system for rotating said belt including (i) a drive roller; (ii) a idle roller; and (iii) a tension roller, wherein said continuous belt receives the fabric roll and rotates the fabric roll to unroll the fabric web at a constant velocity;

(c) a guide frame positioned downstream from said belt drive for directing the fabric web through an inspection area; and (d) a pair of unloader arms connected to said belt drive for receiving the fabric roll, said unloader arms having a first end positioned away from said belt drive for receiving the fabric roll, and a second end for positioning the fabric roll onto said belt drive.

21. The apparatus of claim 20, wherein said unloader arms are positioned at a predetermined width for supporting outer edges of a central shaft which extends through said fabric roll.

22. The apparatus of claim 20, further including grooves located on the top edge of each unloader arm for positioned the fabric roll on and preventing said fabric roll from falling from said unloader arms.

23. The apparatus of claim 22, further including a fabric protector shield positioned over each of said unloader arms for centering the fabric roll on said drive belt and preventing the fabric roll from becoming damaged during unloading.

24. The apparatus of claim 22, further including clamps positioned on each of said unloader arms, said clamps being selectively positionable between an open position for loading and unloading fabric roll and a closed position for locking the fabric roll on said belt drive.

25. The apparatus of claim 20, further including a scale connected to the unloader arms for weighing the fabric roll.

26. The apparatus of claim 20, further including an actuator for raising and lower said unloader arms, said actuator being selectively positionable in a lowered position for loading the fabric roll onto said unloader arms and a raised position for moving the fabric roll onto said belt drive.

27. The apparatus of claim 26, wherein said actuator is pneumatically controlled to lift fabric roll weighing as much as about 450 pounds.

28. The apparatus of claim 20, wherein said guide frame is elevated above said belt drive.

29. The apparatus of claim 20, wherein said guide frame includes an inspection station for inspecting the fabric web being unrolled from the fabric roll, said inspection station being positioned downstream of said belt drive.

30. The apparatus of claim 29, wherein said inspection station includes a screen having a light source and a camera, the fabric web being unwound from the fabric roll passing between said camera and said screen to allow said camera to inspect the fabric web.

31. The apparatus of claim 29, further including a tension drive for pulling the fabric web after being unrolled from the fabric roll, said tension drive including a plurality of rollers for moving the fabric web.

32. The apparatus of claim 31, wherein said plurality of rollers are selectively operable to move the fabric web downstream away from the belt drive after inspection and upstream towards said belt drive for repair.

33. The apparatus of claim 32, further including anti-backlash arms positioned adjacent to each of said plurality of rollers to prevent the fabric web from becoming jammed in said rollers.

34. The apparatus of claim 20, further including support arms for maintaining the fabric roll on said belt, said support arms being spaced a fixed distance apart for holding a central shaft that extends through the fabric roll.

35. The apparatus of claim 20, wherein said belt is seamless to protect the surface of the fabric web.

36. The apparatus of claim 35, wherein said belt is formed from PVC.

37. The apparatus of claim 20, wherein said drive roller is connected to a motor for rotating said belt at a surface speed between about 0 yards per minute (ypm) and up to about 350 ypm.

38. The apparatus of claim 20, wherein said tension roller is attached to a pneumatic actuator for maintaining substantially constant tension between said belt and the surface of the fabric roll.

39. A fabric roll letoff for unwinding a fabric roll, said apparatus comprising:

(a) a continuous belt for supporting the fabric roll; and (b) a drive system for rotating said belt including (i) a drive roller; (ii) a idle roller; and (iii) a tension roller, wherein said continuous belt receives the fabric roll and rotates the fabric roll to unroll the fabric web at a constant velocity; and wherein said tension roller is attached to a pneumatic actuator for maintaining substantially constant tension between said belt and the surface of the fabric roll.

* * * * *